United States Patent [19]

Beyl et al.

[11] Patent Number: 4,483,551

[45] Date of Patent: Nov. 20, 1984

[54] SKI BRAKE

[75] Inventors: Jean J. A. Beyl; Jean Bernard, both of Nevers; René Guerreau, Montmarault; Daniel le Faou, Varennes-Vauzelles; Henri Peyre, Nevers, all of France

[73] Assignee: Ste Look, Nevers, France

[21] Appl. No.: 408,117

[22] Filed: Aug. 13, 1982

[30] Foreign Application Priority Data

Sep. 30, 1981 [FR] France ..... 81 18388

[51] Int. Cl.[3] ..... A63C 7/10

[52] U.S. Cl. ..... 280/605

[58] Field of Search ..... 188/8; 280/12 A, 12 AA, 280/605

[56] References Cited

U.S. PATENT DOCUMENTS 4,128,256 12/1978 Weigl ..... 280/605

FOREIGN PATENT DOCUMENTS 2632847 1/1978 Fed. Rep. of Germany ..... 280/605

2441397 7/1980 France ..... 280/605

*Primary Examiner*—Duane A. Reger

*Attorney, Agent, or Firm*—Young & Thompson

[57] ABSTRACT

A ski brake is provided with two braking arms pivotally mounted in bearings disposed transversely with respect to the ski. The braking arms are downwardly inclined towards the interior of the ski and joined together by means of a resilient stirrup-piece located above the ski and capable of undergoing resilient flexural deformation in its own plane. The stirrup-piece is connected to the braking arms by means of pivot-pins in the form of rivets, the axes of which are located at right angles to the plane of the stirrup-piece.

7 Claims, 12 Drawing Figures

Fig:5
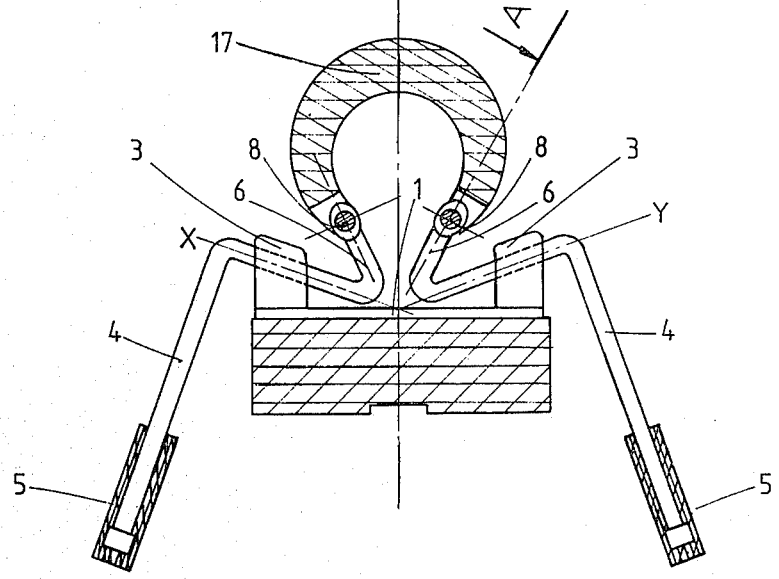
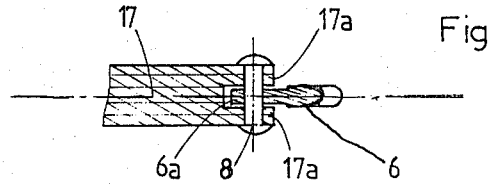
Fig:5A
Fig:6
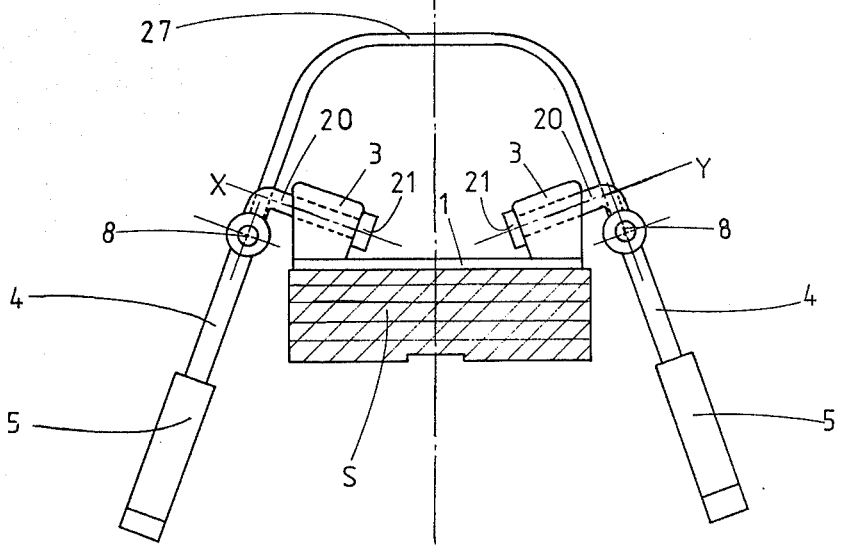

SKI BRAKE

This invention relates to a ski brake and more particularly to a ski brake having two braking arms pivotally mounted in bearings which are placed transversely and downwardly inclined from the exterior to the interior of the ski. The advantage of this type of brake lies in the fact that, when the arms are in the inactive position, they do not project or project only slightly outwards from the sides of the ski.

In a known type of ski brake, the control spring is constituted by a stirrup-piece of resilient wire which works under bending stress and the ends of which are each attached to one braking arm. Said stirrup-piece performs the functions both of a control spring and of an operating pedal. This type of brake is described in French patent application No. 2 441 397 (with reference to FIGS. 5 to 8) and is particularly advantageous by reason of its simple design and low cost price.

Unfortunately, experience has shown that actuation of said brake gives rise to very high stresses which develop within the stirrup-piece. In consequence, said stirrup-piece progressively loses its resilience whilst parasitic friction forces appear in the bearings and absorb a considerable proportion of the braking power.

The invention makes it possible to solve this problem in a particularly simple and effective manner by connecting the stirrup-piece to the braking arms by means of articulated couplings whose axes are perpendicular to the plane of the stirrup-piece. By virtue of this arrangement, bending stresses are uniformly distributed within the stirrup-piece, the ends of said stirrup-piece being pivotally mounted and no longer inset.

The stirrup-piece advantageously has the shape of a C or of a U, depending on whether the articulated couplings are located internally or externally of the ski with respect to the bearings. The stirrup-piece can be formed of spring-steel wire or of molded plastic material.

Other features of the invention will be more apparent upon consideration of the following description and accompanying drawings in which three embodiments of a ski brake according to the invention are shown by way of example and in which:

FIG. 5 is a sectional side view of the second embodiment in which the plane of section corresponds to the plane of the brake;

FIG. 5A shows a detail of FIG. 5, this view being taken in cross-section along the plane A;

FIG. 6 is a side view of the third embodiment;

Figure 1:
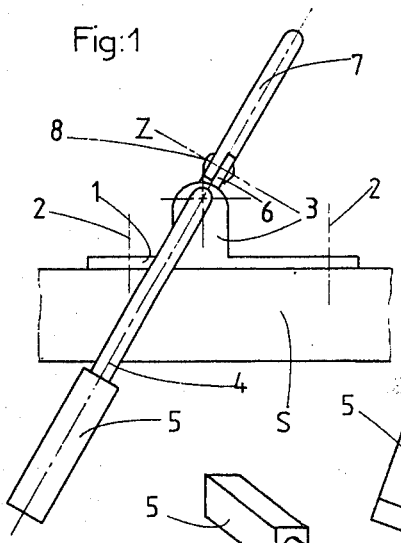
FIG. 1 is a front view of the first embodiment, the brake being in the active braking position.
Figure 2:
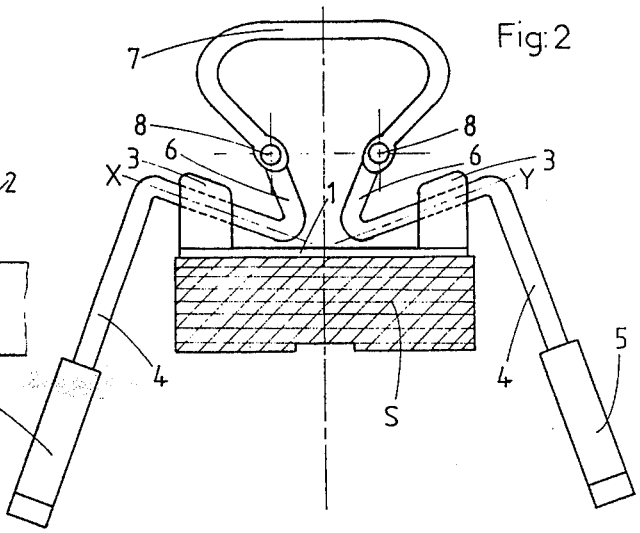
FIG. 2 is a left-hand view of FIG. 1.
Figure 3:
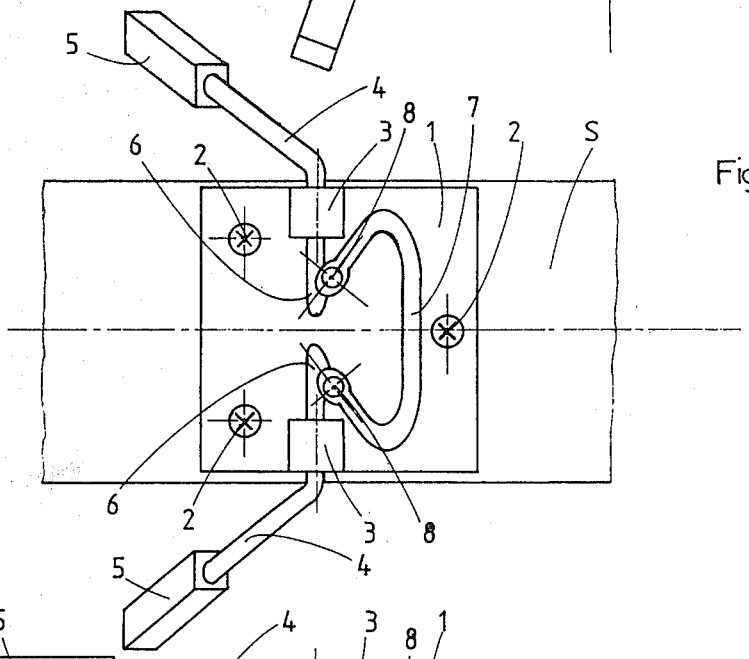
FIG. 3 is a top view of FIG. 1.

The brake shown in FIGS. 1 to 4 comprises a base plate 1 which is fixed on the ski S by suitable means such as screws 2. The plate 1 is provided with a pair of bearings 3, the axes X, Y, of the bores of said bearings being disposed in a vertical plane located transversely with respect to the ski S but downwardly inclined from the exterior to the interior of the ski. There is pivotally mounted in each bearing 3 a braking arm of wire 4 which is fitted in well-known manner with a bearing shoe 5 of overmolded plastic material. The braking arms 4 are provided with extensions in the form of elbowed sections 6 located on the inside with respect to the bearings 3. The brake control spring is constituted by a resilient stirrup-piece 7, the ends of which are attached to the sections 6. The stirrup-piece 7 is made of spring-steel wire and has the shape of a C. According to the invention, the stirrup-piece 7 is attached to the sections 6 by means of articulated couplings having axes Z located at right angles to the plane of the stirrup-piece.

Said articulated couplings placed above the axes X, Y are formed by means of rivets 8 which connect the ends of the stirrup-piece 7 and of the sections 6, said ends having previously been flattened by means of a hammering operation.

Figure 4:
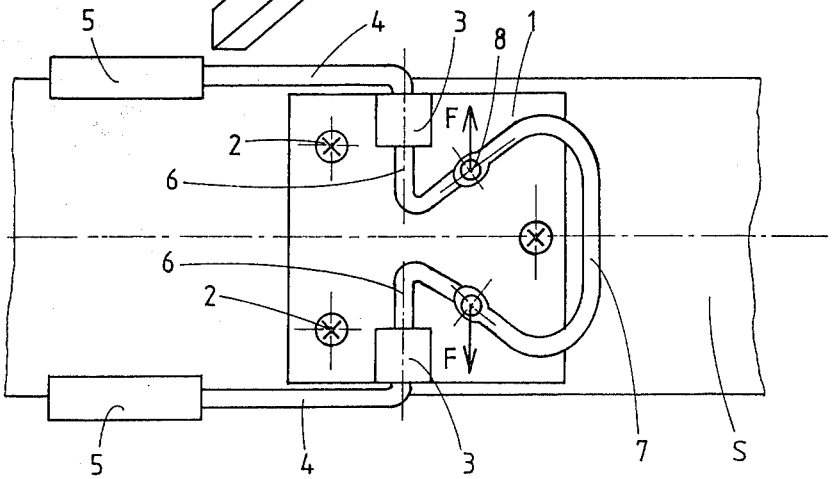
FIG. 4 is a view which is similar to FIG. 3, the brake being in the inactive position.

The operation of the ski is as follows: as he engages his boot on the ski, the skier applies the boot against the stirrup-piece 7 which consequently serves as an operating pedal. The stirrup-piece 7 is thus placed flat on the ski while the braking shoes 5 move upwards towards the center of the ski by reason of the inclined position of the axes X, Y (as shown in FIG. 4). Conversely, during this movement, the sections 6 move away from each other towards the exterior of the ski and have the effect of deforming the stirrup-piece 7 in the direction of its opening (as indicated by the arrows F in FIG. 4). By means of the articulated couplings 8, the stirrup-piece 7 undergoes a natural and uniform deformation while a slight angular displacement takes place between the ends of the stirrup-piece arms and the sections 6.

When the boot is released from the ski, for example as a result of a forward fall which has initiated opening of the safety ski-binding, the boot is no longer applied against the stirrup-piece 7 which consequently undergoes deformation and reverts to its initial shape. This deformation has the effect of bringing the articulated couplings 8 towards each other and of causing a pivotal movement of the braking arms towards their active braking position.

The brake of FIG. 5 differs from the system just described solely in the fact that the resilient stirrup-piece 17 is made of plastic material. The shape and thickness of said stirrup-piece are preferably designed to ensure that the bending stress is the same around the entire periphery of the stirrup-piece. Said stirrup-piece 17 is obtained by molding a thermoplastic resin such as an acetal resin, for example.

FIG. 5A shows the mode of articulated connection between the stirrup-piece 17 and the elbowed arm-sections 6. Thus each end of the stirrup-piece 17 is given the shape of a yoke having cheeks 17*a* between which the flattened end portion 6*a* of the associated arm-section 6 is intended to be engaged, a rivet 8 being used as a coupling pivot for the attachment of said end portion.

The brake of FIG. 6 differs from the preceding embodiments in the fact that the articulation members 8 for pivotally mounting the stirrup-piece 27 on the braking arms 4 are located externally of the ski with respect to the bearings 3 and below the axes X, Y. The end-sections 20 of the braking arms 4 which are mounted within the bearings 3 are each adapted to carry a terminal annular flange 21, the function of which is to prevent said end-sections from escaping from the bearings 3 under the force exerted by the resilient stirrup-piece 27.

The stirrup-piece 27 is made of spring-steel wire which is given the shape of a U. During the lifting of the braking arms to their inactive position, the articulation members 8 move towards each other, with the result that the stirrup-piece is deformed in the direction of closure in this instance. Conversely, when the boot is released from the ski, the stirrup-piece 27 opens so as to revert to its initial shape, thus causing a pivotal displacement of the braking arms 4 to their active braking position.

Figure 7:
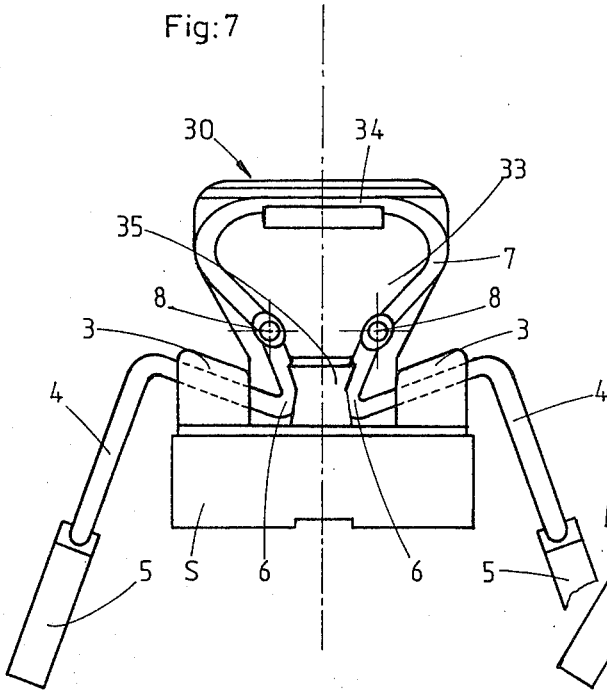
FIG. 7 is a front view which is similar to FIG. 2 and shows the first embodiment of the brake according to the invention, said brake being equipped with a boot-reengagement pallet.
Figure 8:
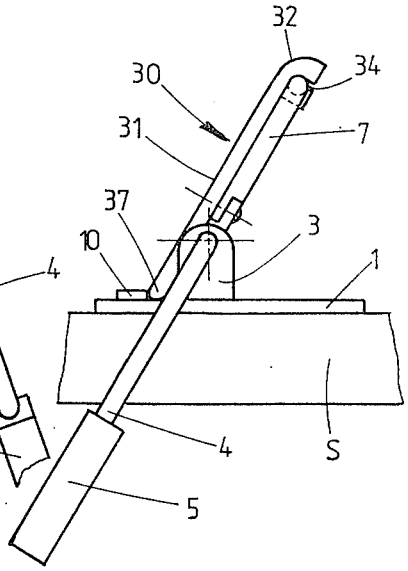
FIG. 8 is a left-hand view of FIG. 7.
Figure 9:
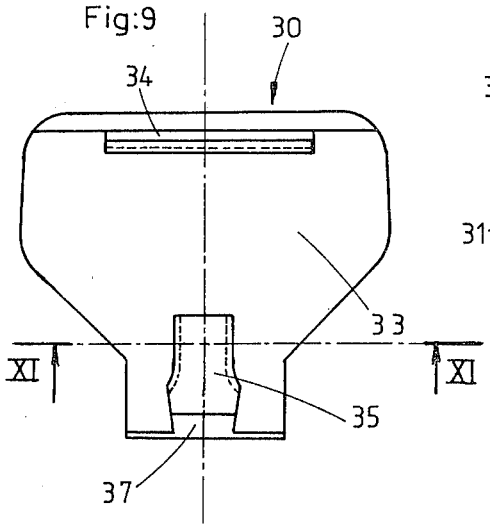
FIG. 9 is a front view of the boot-reengagement pallet which is illustrated alone and drawn to the scale of 1 (enlarged with respect to the scale of the previous figures)
Figure 10:
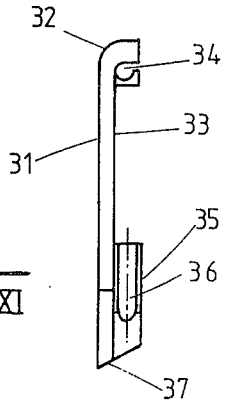
FIG. 10 is a left-hand view of FIG. 9.
Figure 11:
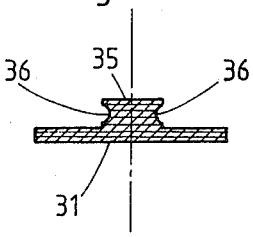
FIG. 11 is a sectional view taken along the plane XI—XI of FIG. 9.

The brake which is illustrated in FIGS. 7 and 8 is identical with the brake of FIGS. 1 to 4 except for the fact that the brake is equipped with a separately mounted boot-reengagement pallet 30. Said pallet is made of molded plastic material such as polyamide, for example, and has a flat dorsal face 31, the top edge 32 of which is rounded. On its ventral face 33, the pallet is provided with a semicylindrical transverse groove 34 and a cylindrical stop 35 having two lateral grooves 36. The pallet 30 is attached to the brake pedal by resilient snap-action engagement, on the one hand of the transverse portion of the stirrup-piece 7 within the groove 34 and on the other hand of the elbowed sections 6 of the arms 4 within the grooves 36. The base plate 1 is provided on its top face with a boss 10 against which the lower portion 37 of the pallet 30 is applied.

The pallet 30 serves to carry out the following functions:

it permits better sliding of the underface of the ski-boot sole against the brake pedal during engagement of the boot within the safety ski-binding;

by virtue of the stop 35, the pedal ensures locking against translational displacement of the braking arms 4 within the bearings 3 towards the interior of the ski, thus preventing any appearance of parasitic friction forces at this level;

by virtue of the cooperation of the lower portion 37 with the boss 10 which serves as a brake-opening stop, the brake has a stable open position which achieves enhanced braking efficiency.

The invention is not limited to the preferential embodiments which have been described in the foregoing solely by way of example but extends on the contrary to all alternative forms. Thus it would be possible to integrate the brake according to the present invention with a safety ski-binding and in particular with a heel-holding member.

What is claimed is:

1. A ski brake comprising two braking arms which are pivotally mounted in bearings disposed transversely with respect to the ski but the axes of which are downwardly inclined towards the interior of the ski, said arms being connected together by means of a resilient stirrup-piece located above the ski and capable of undergoing resilient deformation under bending stress in its own plane, wherein said stirrup-piece is pivotally connected to said braking arms by means of articulation, whose axes are perpendicular to the plane of said stirrup-piece.

2. A ski brake according to claim 1, wherein the stirrup-piece has the shape of a C pivotally connected to the braking arms by means of said articulation, and consequently undergoes deformation in the direction of opening when the braking arms are displaced in pivotal motion to an inactive position.

3. A ski brake according to claim 1, wherein the stirrup-piece has the shape of a U pivotally connected to the braking arms by means of said articulation, located below the axis of the bearings and consequently undergoes deformation in the direction of closure when the braking arms are displaced in pivotal motion to an inactive position.

4. A ski brake according to claim 1, wherein the stirrup-piece is made of spring-steel wire.

5. A ski brake according to claim 1, wherein the stirrup-piece is made of molded plastic material.

6. A ski brake according to claim 1, wherein the articulations are constituted by rivets.

7. A ski brake according to claim 5, wherein said plastic material is a thermoplastic resin.

* * * * *